US009103613B2

(12) United States Patent
Hayes

(10) Patent No.: US 9,103,613 B2
(45) Date of Patent: Aug. 11, 2015

(54) MULTIPLE CARTRIDGE ASSEMBLY FOR LESS THAN LETHAL CARTRIDGE

(71) Applicant: Brejon Holdings (BVI), Ltd., Tortola (VG)

(72) Inventor: John Hayes, Tequesta, FL (US)

(73) Assignee: Brejon Holdings (BVI), Ltd., Tortola (VG)

( * ) Notice: Subject to any disclaimer, the term of this patent is extended or adjusted under 35 U.S.C. 154(b) by 0 days.

(21) Appl. No.: 13/651,870

(22) Filed: Oct. 15, 2012

(65) Prior Publication Data

US 2013/0111797 A1 May 9, 2013

Related U.S. Application Data

(60) Continuation-in-part of application No. 13/472,198, filed on May 15, 2012, which is a continuation-in-part of application No. 13/299,906, filed on Nov. 18, 2011, now Pat. No. 8,511,231, which is a division of application No. 12/359,659, filed on Jan. 26, 2009, now Pat. No. 8,061,274.

(51) Int. Cl.

| | |
|---|---|
| ***F42B 12/34*** | (2006.01) |
| ***F42B 12/74*** | (2006.01) |
| ***F42B 8/02*** | (2006.01) |
| ***F42B 8/12*** | (2006.01) |

(Continued)

(52) U.S. Cl.

CPC ... *F41A 9/61* (2013.01); *F41A 9/85* (2013.01); *F42B 10/00* (2013.01); *F42B 12/34* (2013.01); *F42B 33/001* (2013.01); *F41A 9/24* (2013.01); *F42B 5/02* (2013.01); *F42B 8/02* (2013.01); *F42B 8/12* (2013.01); *F42B 12/74* (2013.01)

(58) Field of Classification Search

CPC ..... F41A 9/85; F41A 9/84; F41A 9/83; F41A 9/82; F41A 9/24; F41A 9/25; F41A 9/26; F41A 9/27; F41A 9/61; F42B 5/02; F42B 8/02; F42B 8/12; F42B 12/34; F42B 12/74; F42B 12/745

USPC ..... 102/439, 444, 447, 502, 529, 293; 42/87, 88, 89

See application file for complete search history.

(56) References Cited

U.S. PATENT DOCUMENTS

| | | | | |
|---|---|---|---|---|
| 863,798 | A * | 8/1907 | Hodges, George S. | 42/87 |
| 1,348,035 | A | 7/1920 | Mossberg | |

(Continued)

FOREIGN PATENT DOCUMENTS

| | | |
|---|---|---|
| GB | 2062818 | 5/1981 |
| WO | WO2010085734 | 7/2010 |

*Primary Examiner* — James S Bergin

(74) *Attorney, Agent, or Firm* — McHale & Slavin, P.A.

(57) ABSTRACT

A multiple cartridge assembly is described which facilitates speed loading of a four barrel less than lethal gun. Four less than lethal cartridges are attached to the multiple cartridge assembly and arranged to correspond with the breech of a four barrel less than lethal gun. Each less than lethal cartridge is constructed with a projectile which when fired has a velocity which will not kill an individual struck by the projectile. The less than lethal cartridge has a rim which is deeper or thicker than a rim on a conventional lethal cartridge. The caliber of the cartridge is also selected so that regular lethal ammunition is not available in this caliber. The preferred caliber of the less than lethal cartridge is 0.490. The less than lethal cartridge contains a polymeric projectile or alternatively, a sealed filled polymeric pouch containing shot therein.

4 Claims, 5 Drawing Sheets

(51) Int. Cl.

| | |
|---|---|
| ***F42B 5/02*** | (2006.01) |
| ***F41A 9/61*** | (2006.01) |
| ***F41A 9/24*** | (2006.01) |
| ***F41A 9/85*** | (2006.01) |
| ***F42B 10/00*** | (2006.01) |
| ***F42B 33/00*** | (2006.01) |

(56) References Cited

U.S. PATENT DOCUMENTS

| | | | | |
|---|---|---|---|---|
| 3,346,983 | A * | 10/1967 | Brooks | 42/47 |
| 3,745,924 | A | 7/1973 | Scanlon | |
| 3,783,787 | A | 1/1974 | Thornley et al. | |
| 3,791,297 | A | 2/1974 | McKee | |
| 4,116,109 | A | 9/1978 | Ervine | |
| 4,422,382 | A | 12/1983 | Marz | |
| 4,679,343 | A * | 7/1987 | Gomez Harlow | 42/87 |
| 5,221,809 | A | 6/1993 | Cuadros | |
| 5,225,628 | A * | 7/1993 | Heiny | 102/438 |
| 5,450,795 | A | 9/1995 | Adelman | |
| 5,698,815 | A | 12/1997 | Ragner | |
| 5,831,199 | A | 11/1998 | McNulty, Jr. et al. | |
| 6,283,037 | B1 * | 9/2001 | Sclafani | 102/502 |
| 6,295,933 | B1 * | 10/2001 | Dubocage et al. | 102/439 |
| 6,302,027 | B1 | 10/2001 | Compton et al. | |
| 6,374,742 | B1 | 4/2002 | Brunn et al. | |
| 6,655,294 | B1 | 12/2003 | Kerr | |
| 6,782,828 | B2 | 8/2004 | Eidener | |
| 6,862,995 | B2 | 3/2005 | Kerr | |
| 6,899,034 | B1 | 5/2005 | Glover et al. | |
| 6,931,993 | B1 | 8/2005 | Manole et al. | |
| 7,089,864 | B2 | 8/2006 | Brunn et al. | |
| 7,204,191 | B2 | 4/2007 | Wiley et al. | |
| 7,278,357 | B2 | 10/2007 | Keith et al. | |
| 7,441,504 | B2 | 10/2008 | Husseini et al. | |
| 7,526,998 | B2 * | 5/2009 | Vasel et al. | 102/502 |
| 7,614,349 | B2 | 11/2009 | Puskas et al. | |
| 8,061,274 | B1 | 11/2011 | Hayes et al. | |
| 8,136,285 | B2 * | 3/2012 | Abell et al. | 42/89 |
| 8,516,729 | B2 * | 8/2013 | Hayes et al. | 42/69.01 |
| 2001/0045173 | A1 | 11/2001 | Gibson et al. | |
| 2003/0094113 | A1 | 5/2003 | Warnagiris et al. | |
| 2003/0129138 | A1 | 7/2003 | Loghman-Adham | |
| 2004/0255813 | A1 | 12/2004 | Kerr | |
| 2005/0066841 | A1 | 3/2005 | Vasel et al. | |
| 2005/0188886 | A1 | 9/2005 | Vasel et al. | |
| 2005/0193689 | A1 | 9/2005 | Basque | |
| 2005/0229807 | A1 | 10/2005 | Brock et al. | |
| 2014/0082984 | A1 * | 3/2014 | Kent et al. | 42/88 |

* cited by examiner

MULTIPLE CARTRIDGE ASSEMBLY FOR LESS THAN LETHAL CARTRIDGE

CROSS REFERENCE TO RELATED APPLICATIONS

In accordance with 37 C.F.R. 1.76, a claim of priority is included in an Application Data Sheet filed concurrently herewith. Accordingly, under 35 U.S.C. §119(e), 120, 121, and/or 365(c) the present invention claims priority, as a continuation-in-part of U.S. patent application Ser. No. 13/472,198 filed on May 15, 2012, and entitled A LESS THAN LETHAL CARTRIDGE, which is a continuation-in-part of U.S. patent application Ser. No. 13/299,906, filed on Nov. 18, 2011, and entitled LESS THAN LETHAL PROJECTILE AND METHOD FOR PRODUCING THE SAME, which is a division of U.S. Pat. No. 8,061,274, issued Nov. 22, 2011 and entitled LESS THAN LETHAL PROJECTILE AND METHOD FOR PRODUCING THE SAME. The present application is also related to U.S. application Ser. No. 13/102,618, filed on May 6, 2011 and entitled REDUCED LETHALITY GUN. The contents of each of the above referenced applications are herein incorporated by reference in its entirety.

FIELD OF THE INVENTION

This invention relates generally to less than lethal weapons, projectiles, and cartridges. In particular, the present invention is an assembly for loading four cartridges simultaneously into a four barrel less than lethal weapon. Each cartridge contains a less than lethal projectile which is not intended to kill an individual and is also intended to minimize causalities. The less than lethal cartridge assembly of the present invention is designed to be usable only in a less than lethal weapon, in that the rim of the less than lethal cartridges are deeper that the rim of a normal lethal cartridge.

BACKGROUND OF THE INVENTION

Law enforcement has long operated with what is called a "continuum of force". It provides guidance to officers for selecting the type of weaponry to use in a variety of situations. The continuum normally begins with verbal commands. Should the subject or subjects not respond, the continuum may advise the next level of force until lethal force is absolutely necessary. In situations such as riots, prisons disturbances, hostage rescues, and the like the continuum of force is utilized. However, officers have long recognized that a wide and dangerous gap exists in the range of tools available to them. In the past, officers had very few options for riot control after verbal commands. Common tactics included advancing walls of officers with batons, or a charge by officers using flats of sabers. However, these tactics still resulted in serious bodily injury due to trampling or excessive police force as they march through crowds; furthermore, innocent civilians were at times injured by inadvertent striking or trampling. It was often that the tactics used were either too weak or too strong a response to some situations. As a result the use of high-pressure fire hoses, electroshock weapons, and non-lethal chemical agents (such as tear gas and offensive odor canisters) were employed to disperse a crowd. Unfortunately, the discretion of officers in utilizing these weapons and tactics led to either misuse by officers or insufficient force applied by officers to maintain peace. In certain situations, like the use of electroshock, the distance between the officer and the subject or subjects is too great for the weapon to be effective. Many of the electroshock weapons rely on an electrical cord or tether to deliver the electrical shock. What is needed in these situations is a less that lethal weapon which can stop the subject without killing them or creating serious bodily injury.

While law enforcement has long recognized the gap in the force of continuum, the concept is relatively new to the military. More and more, military forces are being deployed to situations involving peacekeeping and noncombat operations. A solider must be equipped and trained for peacekeeping and humanitarian assistance operations. In certain situations, law enforcement officers and military soldiers are required to use force to control crowds or individuals, as such less than lethal means are recommended by the force continuum. Less than lethal weapons and tactics are intended to be unlikely to kill or cause great bodily injury, thus minimizing civilian casualties and providing soldiers or officers with an alternative to lethal force.

A less than lethal projectile, provided in a less than lethal weapon, assures that the requisite less than lethal consequence exists and minimizes the soldiers or officers subjectivity in determining the amount of force to use when necessary. Thus heightening the margin of safety for civilians in a riot without minimizing the primary objective: to temporarily incapacitate, confuse, delay, or restrain. One type of projectile commonly used is a beanbag. Another type of impact device launched from a cartridge shell is a less than lethal projectile.

An assembly for speed loading four less than lethal cartridges simultaneously, will increase the efficiency in which soldiers or officers can reload. By affording soldiers or officers the ability to quickly reload, the time frame in which they will have the option of utilizing less than lethal force will be increased.

PRIOR ART

U.S. Pat. No. 6,655,294 discloses a beanbag suitable for installation in a cartridge or shell of a projectile found in a conventional handgun and the process for making the same. The beanbags are fabric bags that contain lead shot or pellets. The round is intended to flatten on impact, hitting face on, thereby spreading its energy over a larger area. When the bag leaves the gun it unrolls and rotates into the flat orientation to strike the target. Unfortunately, if the bag hits before it is completely unfurled or an edge-on orientation, the full force of the impact is distributed over a smaller area, causing more damage. Furthermore, because of their shape (square, rectangular, or circular) the bags are regarded as widely inaccurate and have been known to veer off course.

U.S. Pat. No. 7,089,864 discloses a projectile launched from a weapon shell required at impact to have a low lethality consequence, in which the projectile is fitted in the shell in a shape characterized by a blunt or flat end in the direction of flight. Unfortunately, this low lethality projectile is susceptible to being unstable during its path of flight due to its relatively low weight and slower rate of speed. Furthermore, the projectile is only capable of being fired from a 37mm or 40mm weapon shell thus limiting the selection of munitions available to the officer or soldier. In addition, the disadvantages associated with the low lethality projectile also include the method of producing the same.

U.S. Pat. No. 6,374,742 discloses a method of shaping a projectile comprising the steps of filling an unbounded rear end of an unfilled tubular sock having a closed front end, forming folds in the tubular sock immediately forward of the rear opening, and manually inserting the tubular sock into a projectile compartment of a 37mm or 40mm weapon shell. In so far as the method of sealing the projectile is disclosed as a fold, it is possible that upon impact the projectile may bust, spilling the rubber pellets. Therefore a more reliable seal is desired. Additionally, the method disclosed is not conducive for mass production of the device because it cannot be manufactured on an automated production line. In point of fact, many of the steps of production in the '742 patent involve manual labor.

U.S. Pat. No. 3,745,924 discloses a plastic ballistic cartridge whose ballistics are equivalent to the metallic cartridges at that time and can be fired in existing firearms. The non-expanding metal head is securely attached to the breech end of the plastic casing by compressively squeezing the rear end of the plastic casing between a metal head and a second metallic member, either an annular support member plus a primer or by the primer itself.

U.S. Pat. No. 7,441,504 discloses a base for a cartridge body for ammunition. The base has an ignition device and an attachment device at one end. The attachment device can attach the base to a cartridge casing body. The base is made from plastic, ceramic, or a composite material. This ammunition is a lethal type of ammunition.

U.S. Pat. No. 7,204,191 discloses a lead-free, composite polymer based bullet and cartridge case wherein the composite polymer material includes a tungsten metal powder, nylon 6/6, nylon 6, short glass fibers, as well as additives and stabilizers. The cartridge case includes a lip lock configures to matingly engage a cannelure formed along an outer circumferential surface of the bullet. The cartridge case also includes resilient walls wherein the cast may be formed in a single step process by injection molding or a two-step process including injection molding and a welding process.

While these prior art devices may be suitable for the particular purpose for which they are designed, they would be unsuitable for the purposes of the present invention as heretofore described.

SUMMARY OF THE INVENTION

An objective of this invention is to provide a cartridge assembly for loading four less than lethal cartridges simultaneously into a four barrel less than lethal gun. The cartridges can be integrally formed with the mounting sleeve or in an alternative embodiment can be interchangeable. Each less than lethal cartridge is designed for firing a low pressure less that lethal projectile. The less than lethal cartridge has a rim which is deeper or thicker than a rim on a conventional lethal cartridge. The caliber of the less than lethal cartridge is also selected so that regular, lethal ammunition is not available in this caliber. The preferred caliber is 0.490. The less that lethal cartridge contains a polymeric projectile or alternatively, a sealed filled polymeric pouch which contains shot within.

Accordingly, it is an objective of the present invention to provide a fast and efficient solution for loading and reloading a four barrel less than lethal gun.

It is another objective of the present invention to provide a four cartridge loader which can be individually reloaded.

It is another objective of the present invention to provide a less than lethal cartridge with a less than lethal projectile which can only be used in a weapon designed for less than lethal cartridges.

It is another objective of the present invention to provide a less than lethal cartridge with a projectile which has a rim that is deeper than the rim of a conventional cartridge with a lethal projectile.

It is still another objective of the present invention to provide a less than lethal cartridge with a projectile that will only fire in a weapon that is specifically designed to fire the less than lethal cartridge and will not fire a conventional cartridge that contains a lethal projectile.

It is a further objective of the present invention to provide a less than lethal cartridge with a projectile which has a caliber that conventional lethal ammunition is not available in.

It is a further objective of the present invention to provide a less than lethal projectile that does not kill but stuns and incapacitates.

Another objective of the present invention is to provide a less than lethal projectile comprising a sealed filled pouch constructed of polymeric material which does not burst upon impact.

A further objective of the present invention is to provide a less than lethal cartridge containing a polymeric sealed pouch containing non-toxic shot within. In the rare instance where the polymeric pouch is ruptured on impact or otherwise punctured, the shot therein will not harm the environment or the suspect.

An additional objective of the present invention is to provide a less than lethal cartridge that may be fired from a less than lethal weapon. The pressure in the cartridge being a low pressure, such as below 1000 psi. The speed of the projectile will have a range between 260 and 600 feet per second.

An additional objective of the present invention is to provide a less than lethal cartridge including a polymeric pouch which has a tail on its trailing end to provide stability during flight and accuracy of the projectile.

It is still another objective of the present invention to provide a less that lethal cartridge that can be used in a handgun.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1:
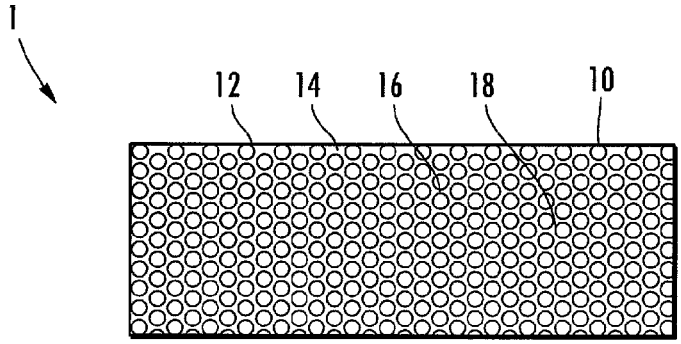
FIG. 1 is a cross sectional view of a polymeric pouch of the present invention.
Figure 2:
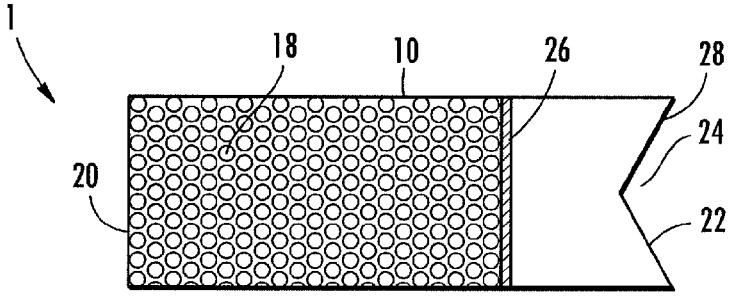
FIG. 2 is a cross sectional view of an alternative polymeric pouch of the present invention.

FIGS. 1-13, which are now referenced, illustrate the present invention and the manner in which it is assembled. Like components are numbered consistently throughout. The less than lethal projectile 1 is constructed from a filled sealed pouch 10 and an empty shell casing 30. As shown in FIG. 1 a pouch 10 is constructed from polymeric material, more specifically, a bi-axially oriented polyethylene terephthalate polyester film (boPET). The boPET film sheet is of sufficient strength to not burst upon impact. The boPET is typically available in a variety of thicknesses, which are measured in 'mils'. The mil is not a metric unit of measure, one mil equals 0.001 inches. It is preferred that the boPET used is at least 4 mils. The boPET film sheet has a high tensile strength and is transparent. Although boPET is the preferred polyester film it is contemplated that other polymeric film sheets may be used in construction of the pouch 10. The pouch 10 includes an outer surface 12 and an inner surface 14 with defines a compartment 16. The compartment is filled with shot 18 of a predetermined amount of tungsten granules, a non-toxic metal. The shot 18 has a weight within the range of 260 to 437.5 grains. In the art, grain is a unit measure of weight. The shot 18 is non-toxic so that in the rare instance that the pouch 10 should burst on impact due to punctures, the shot 18 within will not harm the suspect or the environment. The alternative embodiment of the pouch 10 comprises a leading end 20 and a trailing end 22 as illustrated in FIG. 2.

The pouch 10 includes a tail 24 on the trailing end 22. The leading end 20 is sealed on all edges after the pouch is filled with the shot 18. The leading end 20 and the trailing end 22 are not in communication with each other and include a seam 26 thereinbetween as a means of separation. The tail 24 includes a triangular notch 28. This assists the tail in providing stability to the projectile while the projectile is in flight.

Figure 3:
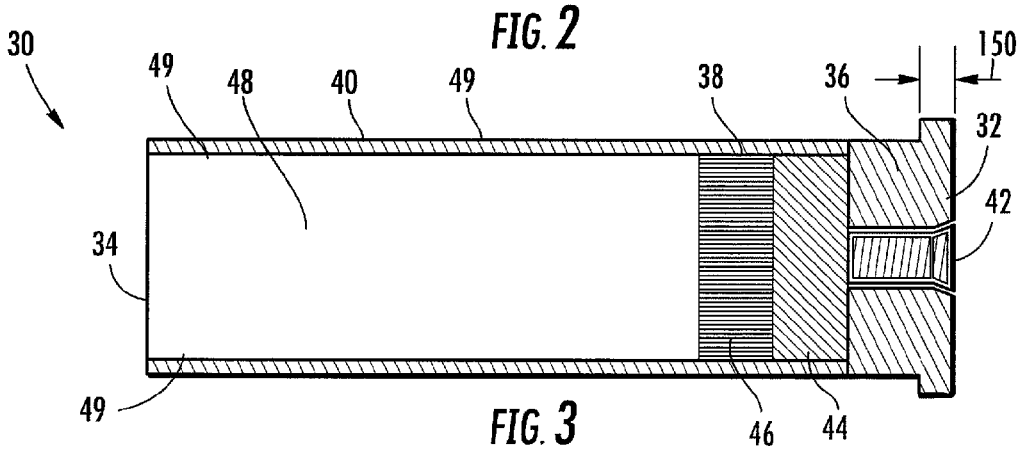
FIG. 3 is a cross sectional view of an exemplary cartridge casing for use with the present invention.

As illustrated in FIG. 3, a less than lethal cartridge 30 is provided. The less than lethal cartridge 30 includes an empty cylindrical shell case 40, a closed end 32, and open end 34. The less than lethal cartridge 30 has a rim portion 36 adjacent the closed end 32, a head portion 38, and a shell case 40 nearest the open end 34. The rim portion 36 includes a primer 42. The primer 42 is in alignment with a firing pin of a weapon (not shown). Adjacent the head portion 38 is the gun powder charge 44 and a wad 46. When the firing pin (not shown) strikes the primer 42, the primer 42 fires and ignites the gun powder 44. The head portion 38 may be constructed of brass, plastic, or any other suitable material. The shell case 40 includes a projectile compartment 48 for receiving and holding the pouch 10 within the cylindrical walls 49 of the shell case 40. When the gun powder 44 is ignited pressure is built up behind the wad 46 and subsequently the wad 46 and pouch 10 are propelled down the barrel of a weapon by the expanding gases from the gun powder.

Figure 4:
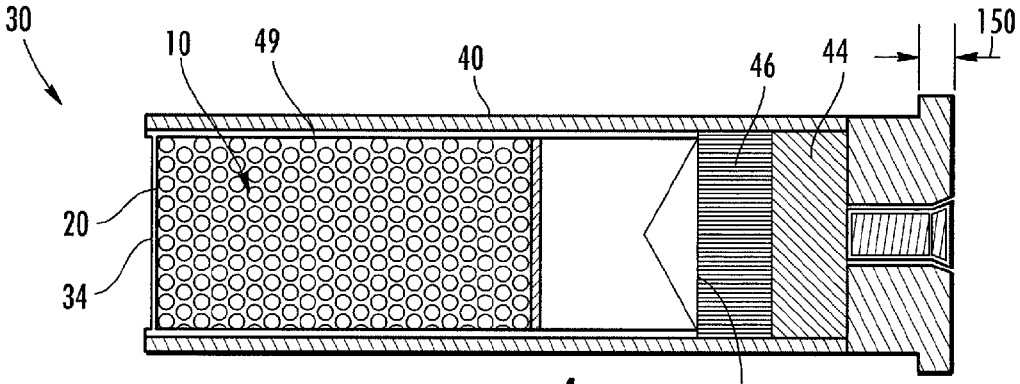
FIG. 4 is a cross sectional view of a cartridge containing the polymeric pouch of the present invention.
Figure 5:
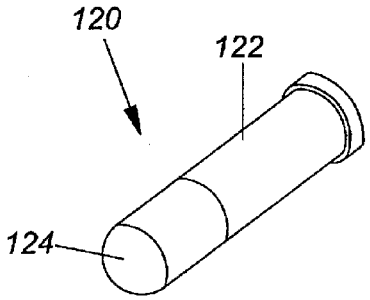
FIG. 5 is a front perspective view of a cartridge of the present invention containing an alternative less than lethal projectile.
Figure 6:
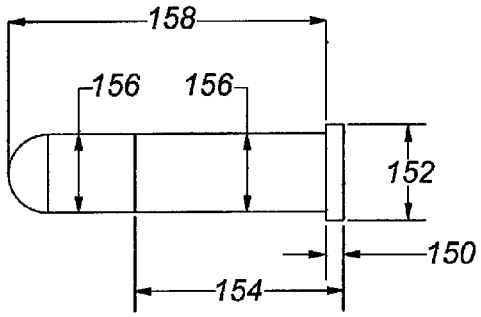
FIG. 6 is a side view of a cartridge of the present invention containing the alternative less that lethal projectile of FIG. 5.

As shown in FIG. 4, the polymeric bag 10 is interposed within the cylindrical walls 49 of the shell case 40 producing a cartridge 30, herein known as a less than lethal cartridge. As defined, a cartridge 30 is ammunition consisting of a cylindrical casing containing an explosive charge and a projectile, which can be fired from a gun. The leading end 20 of the polymeric pouch 10 being nearest the open end 34 of the less than lethal cartridge 30 at the shell case 40 and the trailing end 22 of the polymeric pouch 10 being adjacent to the wad 46 or gun powder 44 depending on the weapon used.

The less than lethal cartridge 30 is capable of being fired from a weapon of low pressure, specifically a weapon having a chamber pressure as low as 600-700 psi. Because of the ability of the less than lethal cartridge 30 to be fired at an extremely low pressure the less than lethal cartridge 30 can be adapted to be fired from any handgun of any size or caliber. Preferably, the firearm used to discharge the less than lethal cartridge 30 comprises of a stationary barrel with a plurality of bores with a revolving firing pin. By way of example U.S. Pat. No. 1,348,035 disclosed such a device. However, it should be noted that the less than lethal projectile is not limited to this type of firearm. It is also contemplated that a rail may be positioned on the firearm. The rail is equipped with a light source of up to 120 lumens, this amount of light may temporarily blind the suspect and provide increase safety to the user. The rail can is also equipped with a laser. The laser capability provides a beam of light towards the intended target. The laser capability allows the user better accurate in firing the firearm. The rail further including a video and audio camera for documentation of the foregoing events.

Figure 7:
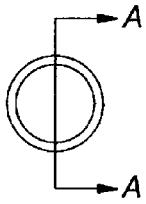
FIG. 7 is a cross sectional view of the cartridge in FIG. 6.
Figure 8:
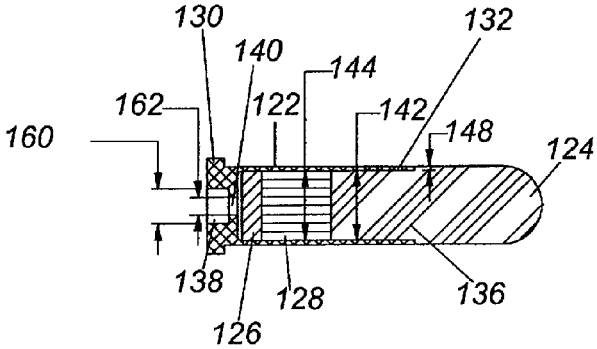
FIG. 8 is a cross sectional view taken along line A-A in FIG. 7.

An alternative embodiment of the present invention is illustrated in FIGS. 5-13. A less than lethal cartridge 120 is illustrated in FIG. 7. The less than lethal cartridge 120 includes a casing 122, a solid projectile or bullet 124, propellant or gun powder 126, a wad 128 and a rim portion 130. The rim portion 130 is secured to one end of the casing 122 and seals off that end of the casing. The casing 122 includes a cylindrical wall portion 132 and an open end 136. The rim portion includes a primer 138. The primer is preferably a mixture of an explosive lead styphnate blended with non-corrosive fuels and oxidizers which burns through a flash hole 140 and ignites the propellant or gun powder 126. The diameter of the primer is preferably 0.207 inches, but can be any other comparable dimension. The flash hole or passageway 140 from the primer to the gun powder 126 is illustrated as having a diameter of 0.080 inches, but can be any other comparable dimension.

The inner diameter of casing 122 varies from 0.435inches at point 142 to 0.430 inches at point 144. This difference in inner diameter of the casing assists in retaining the projectile 124 within the casing 122 until the less than lethal cartridge is fired. While these dimensions are preferable, any other comparable dimensions can be employed. The less than lethal projectile 124 is a single piece made from a polymer. It can be made from a mixture of nylon 6/6, nylon 6 and glass fibers. The percentages of each of the materials of the mixture will vary depending upon the desired physical characteristics of the projectile 124. It can also be made from a mixture of materials having properties similar to those recited hereinabove.

The outer diameter of the casing 122 and the outer diameter of the projectile 124 are the same. In a preferred embodiment the outer diameters are both 0.490 inches. While this is a preferred embodiment, these diameters can be other dimensions. The only requirement is that both outer diameters are the same. The thickness 148 of the shell casing 122 is preferably 0.030 inches. While this is a preferred embodiment, these diameters can be other dimensions. The thickness 150 of the rim 130 is preferably 0.100 inches. The diameter 152 of the rim 130 is preferably 0.566 inches. The length 154 of the casing 122 is preferably 1.250 inches. The caliper or outer diameter 156 of the cartridge, the casing 122 and the projectile 124 are preferably 0.490 inches. The overall length 158 of the less than lethal cartridge 120 is preferably 2.030 inches. The diameter 160 of the primer 138 is preferably 0.207 inches. The diameter 162 of the flash hole 140 is preferably 0.80 inches. While these dimensions are preferred they can be any other comparable dimensions.

Figure 9:
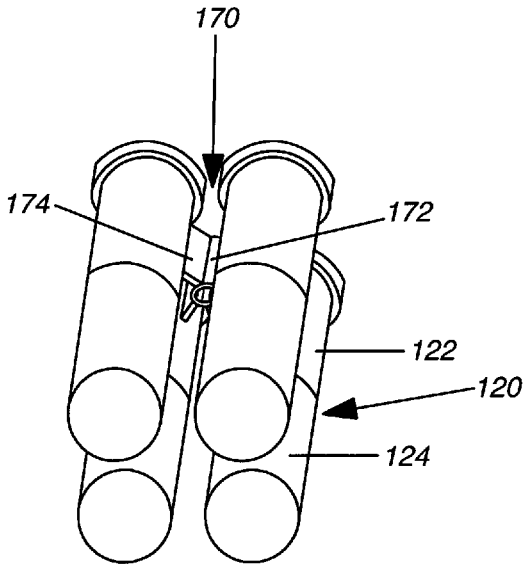
FIG. 9 is a front perspective view of the multiple cartridge assembly connected to four less than lethal cartridges.
Figure 10:
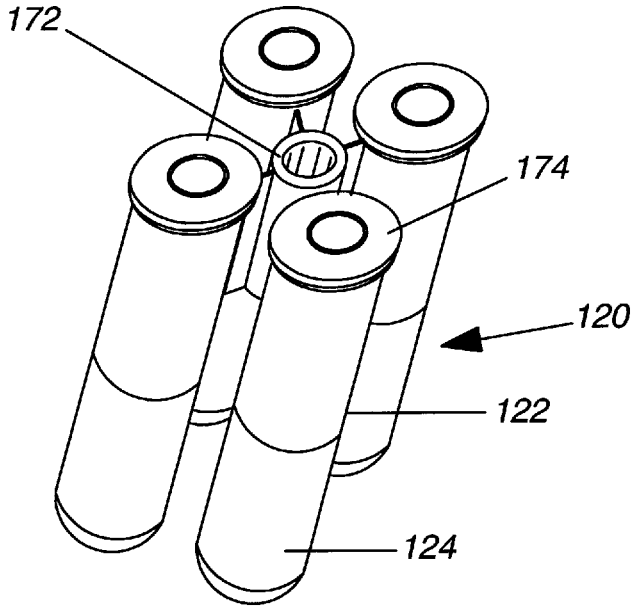
FIG. 10 is a rear perspective view of the multiple cartridge assembly connected to four less than lethal cartridges.
Figure 13:
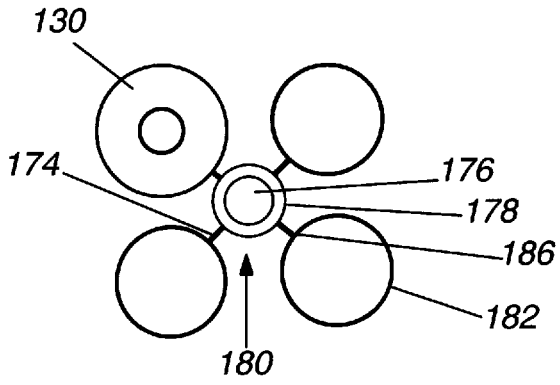
FIG. 13 is a top cross sectional view of the multiple cartridge loader.

A multiple cartridge assembly 170 for use with a less than lethal four barrel gun is illustrated in FIG. 9. The multiple cartridge assembly 170 includes a mounting sleeve 172 for use with four less than lethal cartridges. The mounting sleeve 172 having a dependent tube member of a predetermined length with a continuous sidewall and an inner surface 176 and outer surface 178. At least four mounts 174 are attached and extend longitudinally along the outer surface 178 of the mounting sleeve 172. Each said mount is defined as having a top surface 171, a bottom surface 173 and a plurality of side surfaces 175. In a preferred embodiment, the said mounting sleeve 172 and said mounts 174 are integrally formed. The multiple cartridge assembly 170 cooperates with the breech of a reduced lethality gun. Four less than lethal cartridges 120 are constructed and arranged to cooperate with four barrels of a less than lethal gun. The multiple cartridge assembly 170 can be constructed of brass, plastic or any suitable material.

Figure 11:
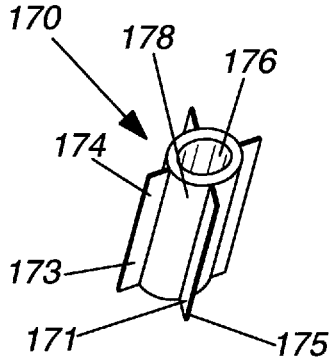
FIG. 11 is a rear perspective view of the multiple cartridge assembly.
Figure 12:
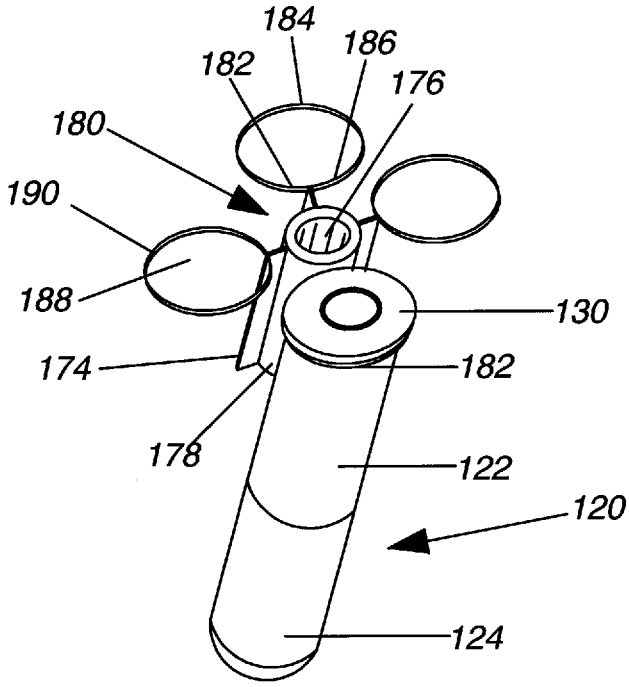
FIG. 12 is a rear perspective view of the multiple cartridge loader.

A multiple cartridge loader 180 for use with a less than lethal four barrel gun is illustrated in FIG. 11. The multiple cartridge loader 180 includes a mounting sleeve 170 defined as a dependent tube member of a predetermined length with a continuous sidewall and having an inner surface 176 and outer surface 178. At least four mounts 174 are attached and extend longitudinally along the outer surface 178 of the mounting sleeve 170. Four rings 182 are constructed and arranged on said mounts 174 to cooperate with the barrels of a less than lethal gun. Each said mount is defined as having a top surface 171, a bottom surface 173 and a plurality of side surfaces 175. Each ring 182 is defined as a dependent annular member having an inner surface 184 and outer surface 186. Each ring inner surface diameter 188 is constructed and arranged to cooperate with the insertion of the less than lethal cartridge. Each ring outer surface 190 is a diameter constructed and arranged to cooperate with a less than lethal gun barrel. In a preferred embodiment, the mounting sleeve, mounts and the rings are integrally formed. The multiple cartridge loader 180 can be constructed of brass, plastic or any suitable material.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A multiple cartridge assembly for use with a less than lethal four barrel gun comprising:

a mounting sleeve for use with four less than lethal cartridges constructed and arranged to be received within a less than lethal gun, said mounting sleeve having a dependent tube member of a predetermined length with a continuous sidewall, said mounting sleeve having an inner and outer surface and at least four mounts attached and extending longitudinally along the outer surface of said mounting sleeve, said mounting sleeve cooperating with an ejector plate wherein operation of said ejector plate causes said mounting sleeve and said four less than lethal cartridges to be ejected from said less than lethal gun;

four less than lethal cartridges, each said less than lethal cartridge further defined as a projectile constructed of a polymeric material, said projectile having an outer surface, a casing, a rim portion, said rim portion being secured to and sealing one end of said casing, said rim portion having a first portion having a first diameter and a second portion having a second diameter, said second diameter being greater that said first diameter, said casing containing a predetermined amount of propellant, a wad contained within said casing and positioned between said propellant and said projectile and said first diameter being substantially the same as outer diameter of said casing, wherein said less than lethal cartridges are positioned by said mounting sleeve to cooperate with four barrels of said less than lethal four barrel gun when said mounting sleeve is received by said less than lethal gun.

2. The multiple cartridge assembly for use with a less than lethal four barrel gun according to claim 1, wherein each said mount is defined as having a top surface, a bottom surface and a plurality of side surfaces.

3. The multiple cartridge assembly for use with a less than lethal four barrel gun according to claim 1, wherein the said mounting sleeve and said mounts are integrally formed.

4. The multiple cartridge assembly for use with a less than lethal four barrel gun according to claim 1, wherein said second portion of said rim portion has a thickness, said thickness being about 0.100 inches.

* * * * *